US007360599B2

(12) United States Patent
Walker et al.

(10) Patent No.: US 7,360,599 B2
(45) **Date of Patent: *Apr. 22, 2008**

(54) DEBRIS REDUCTION PERFORATING APPARATUS AND METHOD FOR USE OF SAME

(75) Inventors: Jerry L. Walker, Fort Worth, TX (US); Jim Gilbert, Rio Vista, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 253 days.

This patent is subject to a terminal disclaimer.

(21) Appl. No.: 10/992,045

(22) Filed: Nov. 18, 2004

(65) Prior Publication Data

US 2006/0102352 A1 May 18, 2006

(51) Int. Cl.
*E21B 43/116* (2006.01)

(52) U.S. Cl. ..... 166/297; 166/55; 166/55.1; 175/4.6

(58) Field of Classification Search ..... 166/297, 166/55, 55.1; 175/4.6; 102/306; 89/1.15
See application file for complete search history.

(56) References Cited

U.S. PATENT DOCUMENTS

| | | | | |
|---|---|---|---|---|
| 4,191,265 | A * | 3/1980 | Bosse-Platiere | 175/4.56 |
| 4,428,440 | A | 1/1984 | McPhee | |
| 4,583,602 | A * | 4/1986 | Ayers | 175/4.52 |
| 4,643,097 | A | 2/1987 | Chawla et al. | |
| 5,837,925 | A * | 11/1998 | Nice | 102/310 |
| 6,336,506 | B2 * | 1/2002 | Wesson | 166/308.1 |
| 6,371,219 | B1 | 4/2002 | Collins et al. | |
| 6,394,184 | B2 * | 5/2002 | Tolman et al. | 166/281 |
| 6,464,019 | B1 * | 10/2002 | Werner et al. | 175/4.6 |
| 6,554,081 | B1 * | 4/2003 | Brooks et al. | 175/4.54 |
| 6,591,911 | B1 * | 7/2003 | Markel et al. | 166/297 |
| 2005/0092493 | A1 * | 5/2005 | Sukup et al. | 166/298 |
| 2005/0235859 | A1 * | 10/2005 | Myers et al. | 102/307 |
| 2006/0108148 | A1 * | 5/2006 | Walker et al. | 175/4.6 |

FOREIGN PATENT DOCUMENTS

GB 2 398 092 A 8/2004

OTHER PUBLICATIONS

Patents Act 1977: Search Report under Section 17; Jan. 6, 2006; 1 page.

* cited by examiner

*Primary Examiner*—Giovanna C Wright
(74) *Attorney, Agent, or Firm*—Lawrence R. Youst

(57) ABSTRACT

A perforating apparatus (100) includes a plurality of shaped charges (102) each having a case, an initiation end and a discharge end. A detonating cord (116) is operably associated with the initiation ends of the shaped charges (102). An energy absorbing charge holder (104) has a detonating cord receiving area to receive the detonating cord therein (116). The energy absorbing charge holder (104) also has a plurality of charge receiving locations that closely receive the shaped charges (102) therein such that upon detonation of the shaped charges (102), energy is transferred from the cases of the shaped charges (102) to the energy absorbing charge holder (104), thereby reducing fragmentation of the cases.

50 Claims, 3 Drawing Sheets

DEBRIS REDUCTION PERFORATING APPARATUS AND METHOD FOR USE OF SAME

TECHNICAL FIELD OF THE INVENTION

This invention relates, in general, to an apparatus for perforating a subterranean wellbore using shaped charges and, in particular, to a debris reduction perforating apparatus that minimizes charge fragmentation within the charge carrier upon detonation of the shaped charges thus reducing wellbore debris.

BACKGROUND OF THE INVENTION

Without limiting the scope of the present invention, its background will be described with reference to perforating a subterranean formation with a shaped charge perforating apparatus, as an example.

After drilling the section of a subterranean wellbore that traverses a formation, individual lengths of relatively large diameter metal tubulars are typically secured together to form a casing string that is positioned within the wellbore. This casing string increases the integrity of the wellbore and provides a path through which fluids from the formation may be produced to the surface. Conventionally, the casing string is cemented within the wellbore. To produce fluids into the casing string, hydraulic opening or perforation must be made through the casing string, the cement and a short distance into the formation.

Typically, these perforations are created by detonating a series of shaped charges located within the casing string that are positioned adjacent to the formation. Specifically, one or more charge carriers are loaded with shaped charges that are connected with a detonating device, such as detonating cord. The charge carriers are then connected within a tool string that is lowered into the cased wellbore at the end of a tubing string, wireline, slick line, coil tubing or other conveyance. Once the charge carriers are properly positioned in the wellbore such that shaped charges are adjacent to the formation to be perforated, the shaped charges are detonated. Upon detonation, each shaped charge creates a jet that blasts through a scallop or recess in the carrier. Each jet creates a hydraulic opening through the casing and the cement and enters the formation forming a perforation.

When the shaped charges are detonated, numerous metal fragments are created due to, among other things, the disintegration of the metal cases of the shaped charges. These fragments often fall out or are blown out of the holes created in the carrier. As such, these fragments become debris that is left behind in the wellbore. It has been found that this debris can obstruct production as well as the passage of tools through the casing during subsequent operations. This is particularly problematic in the long production zones that are perforated in horizontal wells as the debris simply piles up on the lower side of such wells.

A need has therefore arisen for an apparatus and method that reduce the likelihood that debris will be left in the well following perforation. A need has also arisen for such an apparatus and method that will minimize fragmentation of the charge cases following shaped charge detonation. Further, a need has arisen for such an apparatus and method that will enhance the performance of the shaped charges.

SUMMARY OF THE INVENTION

The present invention disclosed herein comprises a debris reduction perforating apparatus and a method for reducing debris caused by perforating a subterranean well using a perforating apparatus. The perforating apparatus of the present invention achieves this result by reducing the fragmentation of the shaped charge cases by transferring the energy created during detonation of the shaped charges from the cases to the charge holder.

The perforating apparatus of the present invention comprises a carrier having an energy absorbing charge holder positioned therein that closely receives a plurality of shaped charges each having a case, a quantity of explosive and liner that forms the jet upon detonation. More specifically, the cases of the shaped charges are closely received in charge receiving locations formed in the energy absorbing charge holder. The initiation ends of the shaped charges are disposed proximate a detonating cord receiving area of the energy absorbing charge holder which receives a detonating cord that is operable to initiate a detonation of the shaped charges. Upon such detonation, energy is transferred from the cases of the shaped charges to the energy absorbing charge holder, thereby reducing fragmentation of the cases.

In one embodiment, the energy absorbing charge holder is formed from a malleable material with suitable yield strength and fracture toughness such as a metal including, but not limited to, aluminum and zinc or a non metal including, but not limited to, phenolics and polymers. In another embodiment, the cases of the shaped charges may be formed from a solid metal including, but not limited to, steel and copper. In addition, the cases of the shaped charges may be constructed using manufacturing processes including, but not limited, cold forming, hot forging, machining, casting, molding or the like.

In one embodiment, the perforating apparatus may include a detonating cord retainer coupled to the energy absorbing charge holder to prevent movement of the detonating cord in the detonating cord receiving area of the energy absorbing charge holder. In another embodiment, the shaped charges may have any suitable phasing such as 10/350 phasing and may be oriented to create, for example, three or more shots per foot.

In another aspect, the present invention is directed to a method for reducing shaped charge case fragmentation associated with perforating a subterranean well using a perforating apparatus. The method includes running the perforating apparatus downhole, detonating the shaped charges having cases contained within an energy absorbing charge holder having a plurality of charge receiving locations that closely receive the shaped charges therein and transferring energy from the cases of the shaped charges to the energy absorbing charge holder, thereby reducing fragmentation of the cases.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
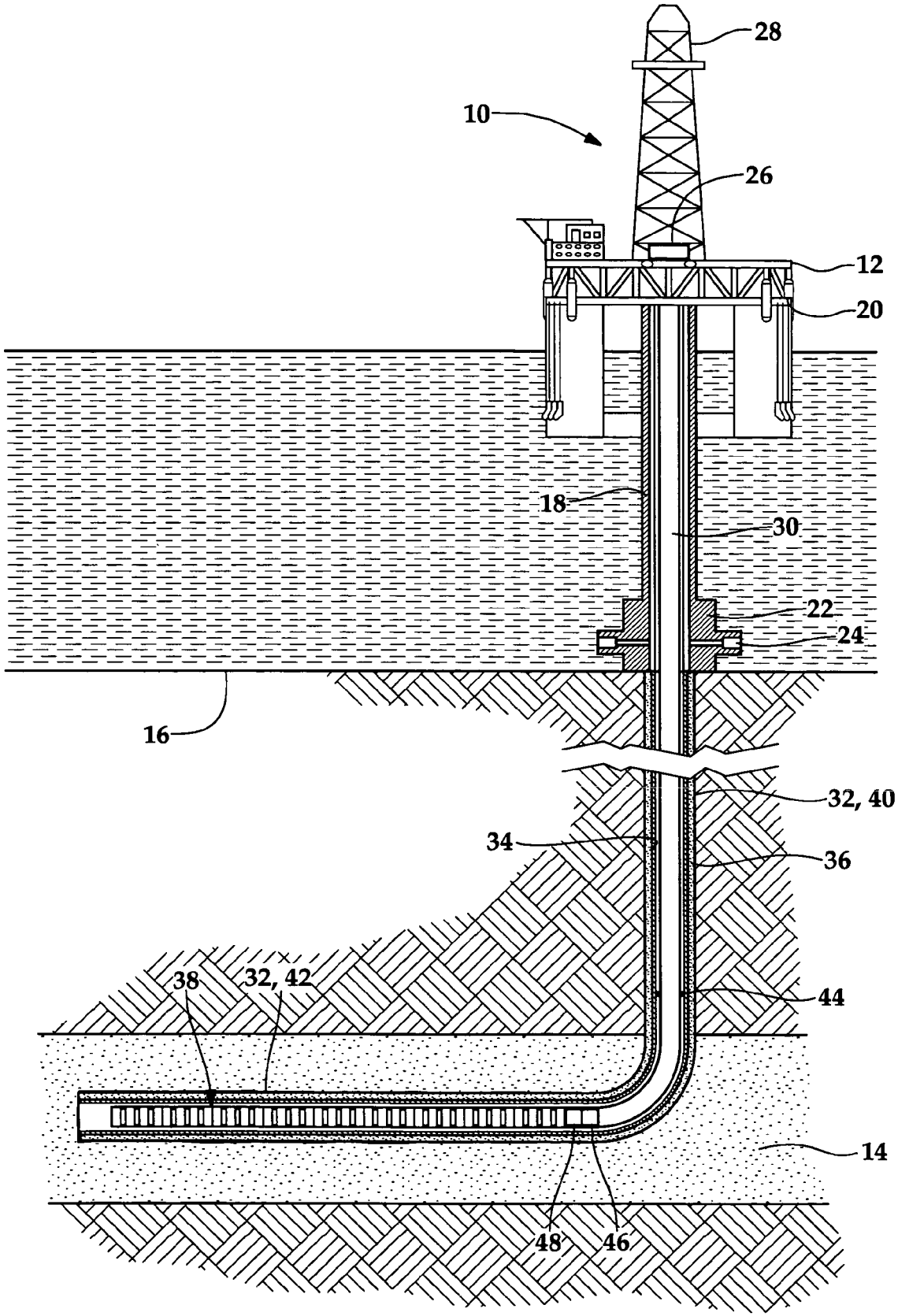
FIG. 1 is a schematic illustration of an offshore oil and gas platform operating a debris reduction perforating apparatus of the present invention.

Referring initially to FIG. 1, a debris reduction perforating apparatus operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26 and a derrick 28 for raising and lowering pipe strings such as work sting 30.

A wellbore 32 extends through the various earth strata including formation 14. A casing 34 is cemented within wellbore 32 by cement 36. Work string 30 includes various tools such as a plurality of perforating guns 38. When it is desired to perforate casing 34, work string 30 is lowered through casing 34 until the perforating guns 38 are properly positioned relative to formation 14. Thereafter, the shaped charges within the string of perforating guns 38 are sequentially fired, either in an uphole to downhole or a downhole to uphole direction. Upon detonation, the liners of the shaped charges form jets that create a spaced series of perforations extending outwardly through casing 34, cement 36 and into formation 14, thereby allow fluid communication between formation 14 and wellbore 32.

In the illustrated embodiment, wellbore 32 has an initial, generally vertical portion 40 and a lower, generally deviated portion 42 which is illustrated as being horizontal. It should be noted, however, by those skilled in the art that the debris reduction perforating guns of the present invention are equally well-suited for use in other well configurations including, but not limited to, inclined wells, wells with restrictions, non-deviated wells and the like.

Work string 30 includes a retrievable packer 44 that may be sealingly engaged with casing 34 in vertical portion 40 of wellbore 32. At the lower end of work string 30 is the gun string including the plurality of perforating guns 38, a ported nipple 46 and a time domain fire device 48. In the illustrated embodiment, perforating guns 38 are preferably internally oriented perforating guns which allow for increased reliability in orienting the shaped charges to shoot in the desired direction or directions as described in U.S. Pat. No. 6,595,290 issued to Halliburton Energy Services, Inc. on Jul. 22, 2003, which is hereby incorporated by reference for all purposes.

Figure 2:
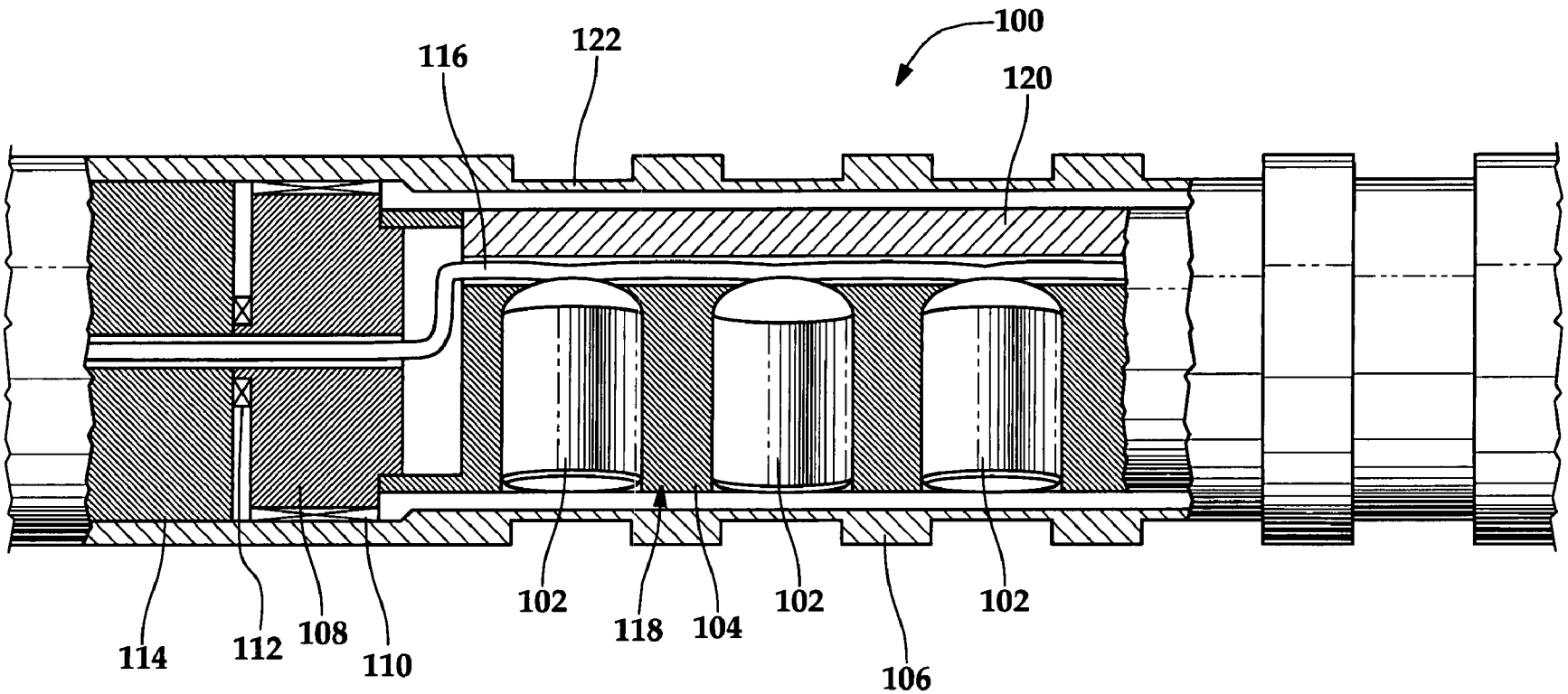
FIG. 2 is partial cut away view of one embodiment of a debris reduction perforating apparatus of the present invention.

Referring now to FIG. 2, therein is depicted a debris reduction perforating apparatus of the present invention that is generally designated 100. In the following description of perforating apparatus 100 as well as the other apparatuses and methods described herein, directional terms such as "above", "below", "upper", "lower" and the like are used for convenience in referring to the illustrations as it is to be understood that the various examples of the invention may be used in various orientations such as inclined, inverted, horizontal, vertical and the like and in various configurations, without departing from the principles of the invention.

Perforating apparatus 100 includes a plurality of shaped charges 102 of which three are pictured in FIG. 2. Each of the shaped charges 102 includes an outer metal case, a liner and a quantity of high explosive disposed therebetween as will be described in greater detail below. Shaped charges 102 are mounted within an energy absorbing charge holder 104 that is positioned within a gun carrier 106. Gun carrier 106 is preferably a cylindrical tubing formed from a metal such as steel. Preferably energy absorbing charge holder 104 is rotatably supported in gun carrier 106 by multiple supports 108, only one such support 108 being visible in FIG. 2. Each of the supports 108 is connected to an end of energy absorbing charge holder 104. This manner of rotatably supporting energy absorbing charge holder 104 at the ends thereof prevents shaped charges 102 and energy absorbing charge holder 104 from contacting the interior of gun carrier 106, however, energy absorbing charge holder 104 is preferably closely received within gun carrier 106. Charges 102 are thereby permitted to reliably rotate within gun carrier 106, regardless of the combined length of the one or more energy absorbing charge holder 104 in gun carrier 106.

Each of the supports 108 includes rolling elements or bearings 110 contacting the interior of gun carrier 106. For example, the bearings 110 could be ball bearings, roller bearings, plain bearings or the like. Bearings 110 enable supports 108 to suspend energy absorbing charge holder 104 in carrier 106 and permit rotation of energy absorbing charge holder 104. In addition, thrust bearings 112 are positioned between supports 108 at each end of carrier 106 and devices 114 attached at each end of carrier 106. Devices 114 may be tandems used to couple two guns to each other, a bull plug used to terminate a gun string, a firing head or any other type of device which may be attached to a gun carrier in a gun string. As with bearings 110 described above, the thrust bearings 112 may be any type of suitable bearings. Thrust bearings 112 support energy absorbing charge holder 104 against axial loading in carrier 106, while permitting energy absorbing charge holder 104 to rotate in carrier 106.

In the illustrated embodiment, gravity is used to rotate charges 102 within carrier 106 to the desired orientation. It is to be clearly understood, however, that other means may be used to rotate charges 102 in keeping with the principles of the invention including, but not limited to, an electric motor, a hydraulic actuator or the like.

Energy absorbing charge holder 104, charges 102 and other portions of perforating apparatus 100 supported in carrier 106 by supports 108 including, for example, a detonating cord 116 extending to each of the charges 102 and portions of the supports themselves are parts of an overall rotating assembly 118. By laterally offsetting the center of gravity of assembly 118 relative to a longitudinal rotational axis passing through perforating apparatus 100 which is the rotational axis of bearings 110, assembly 118 is biased by gravity to rotate to a specific position in which the center of gravity is located directly below the rotational axis.

Assembly 118 may, due to the construction of the various elements thereof, initially have a center of gravity in a desired position relative to charges 102, however, to ensure that charges 102 are directed to shoot in the desired predetermined direction or directions, the center of gravity may be repositioned, or the biasing exerted by gravity may be enhanced, by adjusting the weight of a detonation cord retainer 120 that is attached to energy absorbing charge holder 104 to prevent movement of detonating cord 116. As illustrated, the center of gravity of rotating assembly 118 has directed charges 102 to shoot generally downwardly. Of course, rotating assembly 118 may be otherwise configured to direct charges 102 to shoot in any desired direction, or combination of directions. Even though energy absorbing charge holder 104 has been described as rotatably supported in gun carrier 106, it should be understood by those skilled in the art that energy absorbing charge holder 104 may alternatively be fixed within gun carrier 106.

Carrier 106 is provided with reduced wall thickness portions 122, which circumscribe each of the charges 102. Portions 122 extend circumferentially about carrier 106 outwardly overlying each of the charges 102. Thus, as charges 102 rotate within carrier 106, they remain directed to shoot through portions 122. As such, the jets formed upon detonation of the charges 102 pass through portions 122 at discharge locations.

As stated above, when charges 102 are detonated to perforate the casing, numerous metal fragments are typically created due to the disintegration of the outer metal case of shaped charges 102. In conventional perforating apparatuses, these fragments often fall out or are blown out of the holes created in the carrier and become debris that is left behind in the wellbore. In the present invention, however, the cases are not allowed to become fragmented as the energy created by detonating shaped charges 102 that typically causes such fragmentation is transferred from the cases to charge holder 104 as a result of the close fitting relationship between shaped charges 102 and charge holder 104. Accordingly, the fragmentation of the cases is reduced or eliminated through use of the present invention, thereby reducing the debris that is left behind in the wellbore.

Figure 3:
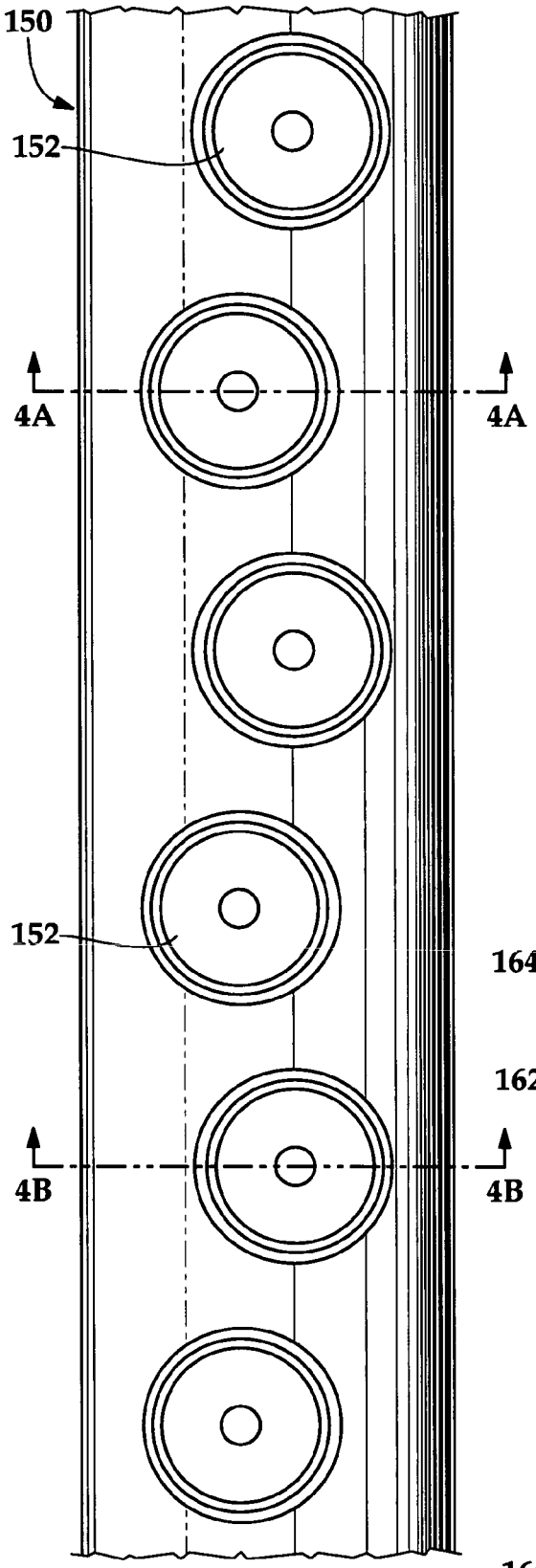
FIG. 3 is side view of one embodiment of a charge holder of a debris reduction perforating apparatus of the present invention.

Referring next to FIG. 3, therein is depicted an energy absorbing charge holder loaded with shaped charges for a debris reduction perforating apparatus of the present invention that is generally designated 150. Energy absorbing charge holder 150 is an elongated, substantially tubular member, formed from a suitably malleable material such that energy absorbing charge holder 150 may be deformed upon the detonation of shaped charges 152. Likewise, energy absorbing charge holder 150 is formed from a material having a suitable yield strength and fracture toughness such that the energy transferred to energy absorbing charge holder 150 upon the detonation of shaped charges 152 does not cause energy absorbing charge holder 150 to fragment. Suitable materials for energy absorbing charge holder 150 are metals including, but not limited to, aluminum, zinc and the like as well as non metals including, but not limited to, phenolics, polymers and the like. Charge holder 150 may be constructed by forging, machining, casting or the like and may be constructed as a single part or in multiple longitudinal or circumferential sections.

Figure 4A:
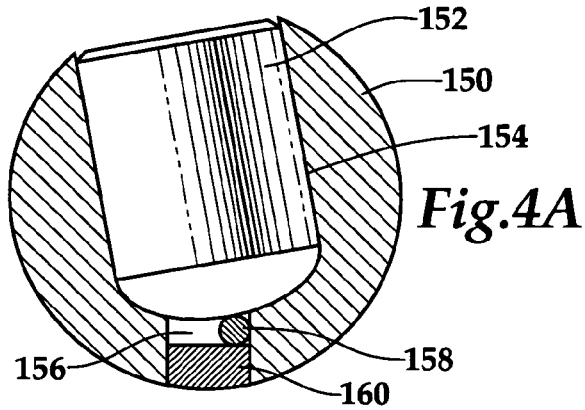
FIGS. 4A-4B are partial cross sectional views respectively taken along lines 4A-4A and 4B-4B of FIG. 3 depicting a shaped charge closely received within a charge receiving location of the charge holder of a debris reduction perforating apparatus of the present invention.
Figure 4B:
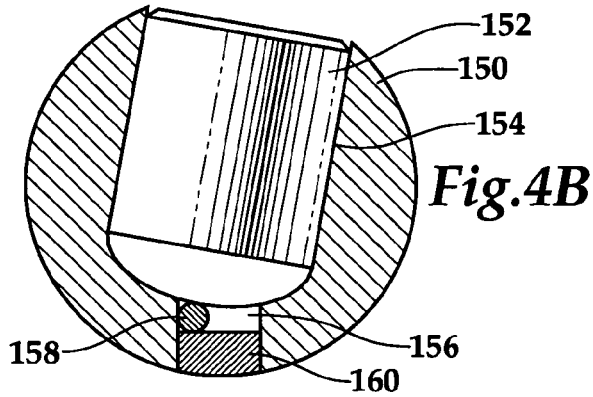

As best seen in FIGS. 4A-4B, energy absorbing charge holder 150 has a plurality of shaped charge receiving locations 154 formed therein. Depending upon the type of material processing used to form energy absorbing charge holder 150, shaped charge receiving locations 154 may, for example, be machined in energy absorbing charge holder 150. Shaped charges 152 are securably disposed in the shaped charge receiving locations 154 in a close fitting relationship such that upon the detonation of shaped charges 152, energy is transferred from shaped charges 152 to energy absorbing charge holder 150. In some embodiment, shaped charges 152 may be retained within shaped charge receiving locations 154 using suitable retaining members such as pins, screws, adhesives and the like or may be retained via a friction fit or combinations thereof. As can be seen, the solid metal of energy absorbing charge holder 150 substantially surrounds shaped charges 152 but for the region proximate the initiation ends of shaped charges 152 which extends into a detonation cord receiving area 156 of energy absorbing charge holder 150. As such, use of the term energy absorbing charge holder herein refers to any solid or substantially solid structure or other energy absorbing structure that is capable of closely receive the shaped charge such that energy can be transferred from the cases of the shaped charges to the charge holder to reduce or prevent fragmentation of the cases including, but not limited to, solid charge holders, charge holders having sections that have been removed or are otherwise not completely solid, charge holders having energy absorbing fluids, gels or materials disposed therein, charge holders having multiple material layers that sequentially absorb energy and the like.

A detonating cord 158 is positioned in detonation cord receiving area 156 and is in explosive proximity to the initiation ends of shaped charges 152. After detonating cord 158 has been installed within detonation cord receiving area 156 of energy absorbing charge holder 150, a detonating cord retainer 160 may be installed to prevent further movement of detonating cord 158. Also, in some embodiments as explained above, detonating cord retainer 160 may be used to adjust the center of gravity of energy absorbing charge holder 150 to direct charges 152 to shoot in the desired direction or combination of directions. As such, detonating cord retainer 160 may be formed from any suitable material including, but not limited to, metals such as steel, aluminum, zinc and the like.

In the illustrated embodiment, shaped charges 152 are arranged using 10/350 phasing wherein each shaped charge is disposed on its own level or height and is to be individually detonated so that only one shaped charge is fired at a time and wherein each shaped charge is offset from the adjacent shaped charges by twenty degrees. It should be noted, however, by those skilled in the art that alternate arrangements of shaped charges may be used without departing from the principles of the present invention. For example, other types of phasing arrangements including spiral patterns with between about 10 degree and about 270 degree phasing as well as cluster type designs wherein more than one shaped charge is at the same level and is detonated at the same time may be used with energy absorbing charge holder 150. In the illustrated embodiment, shaped charges 152 are arranged to allow for directional control of the perforation locations, for example in the up direction of a horizontal well. Likewise, the arrangement of shaped charges 152 in the present example allow for the user of large shaped charges relative to the size of the wellbore as there is only one shaped charge at a given level which translates to enhanced depth of penetrations and thereby performance.

Figure 5A:
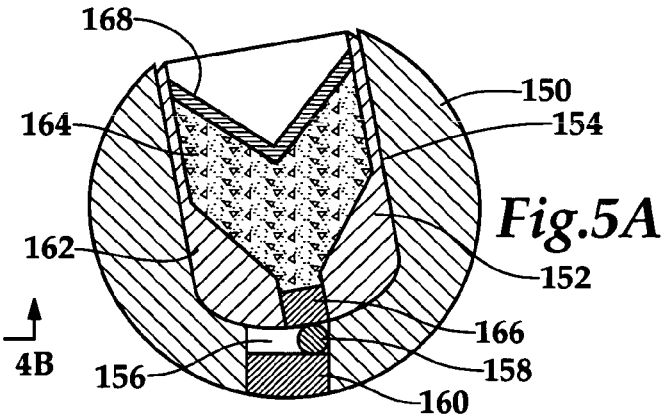
FIG. 5A is a cross sectional view of a shaped charge closely received within a charge receiving location of the charge holder of a debris reduction perforating apparatus of the present invention prior to detonation.

Referring next to FIG. 5A, therein is depicted a cross sectional view of energy absorbing charge holder 150 loaded with a shaped charge 152 for a debris reduction perforating apparatus of the present invention. As seen, shaped charge 152 has a generally cylindrically shaped outer case 162. Case 162 may be constructed from a metal such as steel, copper or the like and may be formed using a cold forming technique, a hot forging technique, machining, casting, molding or other suitable material forming process. A quantity of high explosive powder 164 is disposed within case 162. High explosive powder 164 may be selected from many that are known in the art for use in shaped charges such as the following which are sold under trade designations HMX, HNS, RDX, HNIW and TNAZ. In the illustrated embodiment, high explosive powder 164 is detonated using a detonating signal provided by detonating cord 158. A booster explosive 166 is disposed between detonating cord 158 and high explosive powder 164 to efficiently transfer the detonating signal from detonating cord 158 to high explosive powder 164.

A liner 168 is also disposed within case 162 such that high explosive 164 substantially fills the volume between case 162 and liner 168. Liner 168 may be any suitable liner and may be formed by pressing, under very high pressure, a powdered metal mixture. Following the pressing process, liner 168 becomes a generally conically shaped rigid body that behaves substantially as a solid mass.

In operation, when high explosive powder 164 is detonated using detonating cord 158, the force of the detonation collapses liner 168 causing liner 168 to be ejected from case 162 in the form of a jet of particles traveling at very high velocity toward, for example, a well casing. The jet penetrates the well casing, the cement and the formation, thereby forming a perforation. Not all of the energy from the detonation of high explosive powder 164, however, is used to form and propel the jet. Some of the energy is transferred to case 162, which typically causes the case of the shaped charge to fragment.

Figure 5B:
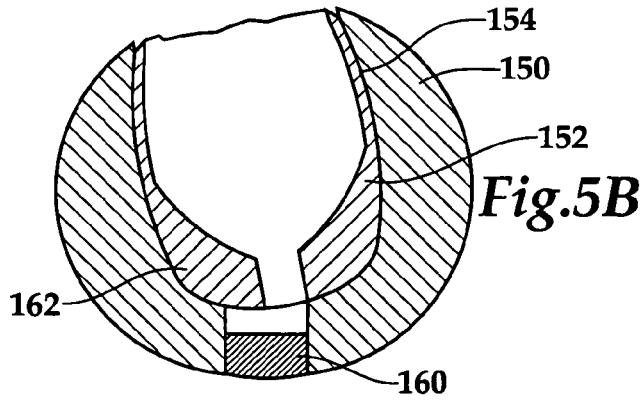
FIG. 5B is a cross sectional view of the charge holder of a debris reduction perforating apparatus of the present invention after detonation of the shaped charge in FIG. 5A.

Using charge holder 150 of the present invention reduces or prevents this fragmentation of case 162 as case 162 is closely received within charge holder 150. Instead of fragmenting case 162, the energy from the detonation of high explosive powder 164 is transferred from case 160 to charge holder 150 causing charge holder 150 to deform, thereby absorbing the energy. As best seen in FIG. 5B, charge holder 150 is bowed radially outwardly about its center plane generally perpendicular to the direction of the jet propagation. As such, case 162 is not only retained within charge holder 150, but also, case 162 remains substantially in one piece following the detonation of shaped charge 152, thereby reducing the likelihood that case fragments are left in the wellbore following the perforating operation. In addition, in some embodiment wherein charge holder 150 is closely received within the gun carrier, some of the energy from the detonation of high explosive powder 164 may also be transferred from charge holder 150 to the gun carrier, thereby also reducing the likelihood of cracking or otherwise fragmenting charge holder 150.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A perforating apparatus comprising:

a carrier;

a solid metal energy absorbing charge holder formed from a single metal component positioned within the carrier, the energy absorbing charge holder having a plurality of charge receiving locations formed therein and a detonating cord receiving area;

a plurality of shaped charges each having a case, the shaped charges positioned within the charge receiving locations of the energy absorbing charge holder such that the energy absorbing charge holder substantially surrounds the shaped charges, the shaped charges each having an initiation end and a discharge end, the initiation ends being disposed proximate the detonating cord receiving area of the energy absorbing charge holder; and a detonating cord positioned within the detonating cord receiving area of the energy absorbing charge holder and operable to initiate a detonation of the shaped charges, wherein the cases of the shaped charges are closely received within the charge receiving locations of the energy absorbing charge holder such that upon detonation of the shaped charges, energy is transferred from the cases to the energy absorbing charge holder, thereby reducing fragmentation of the cases.

2. The perforating apparatus as recited in claim 1 wherein the energy absorbing charge holder is rotatably mounted within the carrier.

3. The perforating apparatus as recited in claim 1 wherein the energy absorbing charge holder is mounted in a fixed position relative to the carrier.

4. The perforating apparatus as recited in claim 1 wherein the energy absorbing charge holder further comprises a malleable material.

5. The perforating apparatus as recited in claim 1 wherein the energy absorbing charge holder further comprises at least one of a material selected from aluminum and zinc.

6. The perforating apparatus as recited in claim 1 wherein the energy absorbing charge holder is closely received within the carrier.

7. The perforating apparatus as recited in claim 1 wherein the cases of the shaped charges further comprise a solid metal.

8. The perforating apparatus as recited in claim 1 wherein the cases of the shaped charges further comprise steel.

9. The perforating apparatus as recited in claim 1 wherein the cases of the shaped charges further comprise copper.

10. The perforating apparatus as recited in claim 1 wherein the cases of the shaped charges further comprise a material that is processed by at least one of cold forming, hot forging, machining, casting and molding.

11. The perforating apparatus as recited in claim 1 further comprising a detonating cord retainer coupled to the energy absorbing charge holder.

12. The perforating apparatus as recited in claim 1 wherein the shaped charges are circumferentially phased.

13. The perforating apparatus as recited in claim 12 wherein the shaped charges have 10/350 phasing.

14. The perforating apparatus as recited in claim 1 wherein the shaped charges are oriented to create at least 3 shots per foot.

15. A perforating apparatus comprising;

a plurality of shaped charges each having a case, an initiation end and a discharge end;

a detonating cord operably associated with the initiation ends of the shaped charges; and a solid metal energy absorbing charge holder formed from a single metal component having a detonating cord receiving area to receive the detonating cord therein and a plurality of charge receiving locations that closely receive the shaped charges therein such that the energy absorbing charge holder substantially surrounds the shaped charges and such that upon detonation of the shaped charges, energy is transferred from the cases of the shaped charges to the energy absorbing charge holder, thereby reducing fragmentation of the cases.

16. The perforating apparatus as recited in claim 15 wherein the charge holder is rotatably mounted within a carrier.

17. The perforating apparatus as recited in claim 15 wherein the charge holder is mounted in a fixed position relative to the carrier.

18. The perforating apparatus as recited in claim 15 wherein the charge holder further comprises a malleable material.

19. The perforating apparatus as recited in claim 15 wherein the charge holder further comprises at least one of a material selected from aluminum and zinc.

20. The perforating apparatus as recited in claim 15 wherein the charge holder is closely received within a carrier.

21. The perforating apparatus as recited in claim 15 wherein the cases of the shaped charges further comprise a solid metal.

22. The perforating apparatus as recited in claim 15 wherein the cases of the shaped charges further comprise at least one of a material selected from steel and copper.

23. The perforating apparatus as recited in claim 15 wherein the cases of the shaped charges further comprise a material that is processed by at least one of cold forming, hot forging, machining, casting and molding.

24. The perforating apparatus as recited in claim 15 further comprising a detonating cord retainer coupled to the charge holder.

25. The perforating apparatus as recited in claim 15 wherein the shaped charges are circumferentially phased.

26. The perforating apparatus as recited in claim 25 wherein the shaped charges have 10/350 phasing.

27. The perforating apparatus as recited in claim 15 wherein the shaped charges are oriented to create at least 3 shots per foot.

28. A charge holder for a perforating apparatus comprising:

a solid metal energy absorbing substantially tubular member formed from a single metal component having a detonating cord receiving area to receive a detonating cord therein and a plurality of charge receiving locations that closely receive shaped charges having cases therein such that the energy absorbing tubular member substantially surrounds the shaped charges and such that upon detonation of the shaped charges, energy is transferred from the cases of the shaped charges to the energy absorbing substantially tubular member, thereby reducing fragmentation of the cases.

29. The charge holder as recited in claim 28 wherein the energy absorbing substantially tubular member further comprises a malleable material.

30. The charge holder as recited in claim 28 wherein the energy absorbing substantially tubular member further comprises at least one of a material selected from aluminum and zinc.

31. The charge holder as recited in claim 28 wherein the cases of the shaped charges further comprise a solid metal.

32. The charge holder as recited in claim 28 wherein the cases of the shaped charges further comprise at least one of a material selected from steel and copper.

33. The charge holder as recited in claim 28 wherein the cases of the shaped charges further comprise a material that is processed by at least one of cold forming, hot forging, machining, casting and molding.

34. The charge holder as recited in claim 28 further comprising a detonating cord retainer coupled to the energy absorbing substantially tubular member.

35. The charge holder as recited in claim 28 wherein the shaped charges are circumferentially phased.

36. The charge holder as recited in claim 35 wherein the shaped charges have 10/350 phasing.

37. The charge holder an recited in claim 28 wherein the shaped charges are oriented to create at least 3 shots per foot.

38. A method for reducing fragmentation of shaped charge cases in perforating a subterranean well using a perforating apparatus, the method comprising the steps of:

running the perforating apparatus downhole;

detonating the shaped charges contained within a solid metal energy absorbing charge holder formed from a single metal component having a plurality of charge receiving locations that closely receive the shaped charges therein such that the energy absorbing charge holder substantially surrounds the shaped charges; and transferring energy from the cases of the shaped charges to the charge holder, thereby reducing fragmentation of the cases.

39. The method as recited in claim 38 further comprising rotatably mounting the charge holder within a carrier.

40. The method as recited in claim 38 further comprising fixably mounting the charge holder within a carrier.

41. The method as recited in claim 38 wherein the charge holder further comprises a malleable material.

42. The method as recited in claim 38 wherein the charge holder further comprises at least one of a material selected from aluminum and zinc.

43. The method as recited in claim 38 further comprising closely receiving the charge holder within a carrier.

44. The method as recited in claim 38 wherein the cases of the shaped charges further comprise a solid metal.

45. The method as recited in claim 38 wherein the cases of the shaped charges further comprise at least one of a material selected from steel and copper.

46. The method as recited in claim 38 wherein the cases of the shaped charges further comprise a material that is processed by at least one of cold forming, hot forging, machining, casting and molding.

47. The method as recited in claim 38 further comprising coupling a detonating cord retainer to the charge holder.

48. The method as recited in claim 38 wherein the step of detonating shaped charges further comprises detonating shaped charges having circumferential phasing.

49. The method as recited in claim 48 wherein the step of detonating shaped charges having circumferential phasing further comprises detonating shaped charges having 10/350 phasing.

50. The method as recited in claim 38 wherein the step of detonating shaped charges further comprises detonating shaped charges to create at least 3 shots per foot.

* * * * *